US005405412A

United States Patent [19]

Willey et al.

[11] Patent Number: 5,405,412

[45] Date of Patent: Apr. 11, 1995

[54] BLEACHING COMPOUNDS COMPRISING N-ACYL CAPROLACTAM AND ALKANOYLOXYBENZENE SULFONATE BLEACH ACTIVATORS

[75] Inventors: Alan D. Willey, Cincinnati; Michael E. Burns, West Chester; Jerome H. Collins, Cincinnati, all of Ohio

[73] Assignee: The Procter & Gamble Company, Cincinnati, Ohio

[21] Appl. No.: 226,915

[22] Filed: Apr. 13, 1915

Related U.S. Application Data

[63] Continuation-in-part of Ser. No. 64,627, May 20, 1993, abandoned.

[51] Int. Cl.[6] ..... C11D 3/28; C11D 3/395; C11D 3/34; C11D 3/02

[52] U.S. Cl. ..... 8/111; 8/137; 134/2; 252/99; 252/102; 252/186.39; 252/524; 252/542; 252/174

[58] Field of Search ..... 252/99, 102, 524, 542, 252/186.39; 8/111, 137; 134/2

[56] References Cited

U.S. PATENT DOCUMENTS

| | | | |
|---|---|---|---|
| 3,177,148 | 4/1965 | Bright et al. | 252/99 |
| 4,013,575 | 3/1977 | Castrantas | 252/104 |
| 4,412,934 | 11/1983 | Chung et al. | 252/186 |
| 4,541,944 | 9/1985 | Sanderson | 252/95 |
| 4,545,784 | 10/1985 | Sanderson | 8/107 |

FOREIGN PATENT DOCUMENTS

| | | | |
|---|---|---|---|
| A068547 | 1/1983 | European Pat. Off. | 252/95 |
| A57700 | 3/1988 | European Pat. Off. | 252/99 |
| 1596313 | 8/1981 | United Kingdom . | |
| 2189520 | 10/1987 | United Kingdom . | |

*Primary Examiner*—Dennis Albrecht

*Attorney, Agent, or Firm*—Michael D. Jones; Jerry J. Yetter; Jacobus C. Rasser

[57] ABSTRACT

Laundry detergents and automatic dishwashing compositions with activated bleaching systems which are effective under mixed soil conditions, especially mixtures of hydrophobic and hydrophilic soils and stains are presented. The preferred bleach activators are N-acyl caprolactams and nonanoyloxybenzene sulfonate. A particularly preferred embodiment comprises a 1:2.2:7.7 molar ratio of N-acyl caprolactam to alanoyloxybenzenesulfonate to peroxygen bleaching compound. This mixed caprolactam, alkanoyloxybenzenesulfonate bleaching composition delivers stronger than expected performance on both hydrophobic and hydrophilic stains and on dingy clean up.

8 Claims, No Drawings

BLEACHING COMPOUNDS COMPRISING N-ACYL CAPROLACTAM AND ALKANOYLOXYBENZENE SULFONATE BLEACH ACTIVATORS

CROSS REFERENCE TO RELATED APPLICATIONS

This application is a continuation-in-part of application Ser. No. 08/064,627, filed May 20, 1993, now abandoned.

FIELD OF THE INVENTION

The present invention relates to laundry detergents and automatic dishwashing compositions with activated bleaching systems which are effective under mixed soil conditions, especially mixtures of hydrophobic and hydrophilic soils and stains.

BACKGROUND OF THE INVENTION

It has long been known that peroxygen bleaches are effective for stain and/or soil removal from fabrics, but that such bleaches are temperature dependent. At a laundry liquor temperature of 60° C., peroxygen bleaches are only partially effective. As the laundry liquor temperature is lowered below 60° C., peroxygen bleaches become relatively ineffective. As a consequence, there has been a substantial amount of industrial research to develop bleaching systems which contain an activator that renders peroxygen bleaches effective at laundry liquor temperatures below 60° C.

Numerous substances have been disclosed in the art as effective bleach activators. One widely-used bleach activator is tetraacetyl ethylene diamine (TAED). TAED provides effective hydrophilic cleaning especially on beverage stains, but has limited performance on dingy stains and body soils. Another type of activator, such as nonanoyloxy-benzenesulfonate (NOBS) and other activators which generally comprise long chain alkyl moieties, is hydrophobic in nature and provides excellent performance on dingy stains.

It would seem that a combination of bleach activators, such as TAED and NOBS, would provide an effective detergent composition which would perform well on both hydrophilic and hydrophobic soils and stains. However, many of the hydrophilic activators developed thus far, including TAED, have been found to have limited efficacy, especially at laundry liquor temperatures below 60° C. Another consideration in the development of consumer products effective on both types of soils is the additional costs associated with the inclusion of two or more bleach activators. Accordingly, it is of substantial interest to the manufacturers of bleaching systems to find a less expensive type of hydrophilic bleaching activator.

By the present invention, it has now been discovered that the class of bleach activators derived from hydrophilic N-acyl caprolactams performs very well when combined with the cleaning performance of hydrophobic alkanoyloxybenzenesulfonate and has the added benefit of being relatively inexpensive to manufacture. Accordingly, the present invention solves the long-standing need for an inexpensive bleaching system which performs efficiently and effectively at low temperatures and under mixed soil load conditions, especially mixtures of hydrophobic and hydrophilic soils.

BACKGROUND ART

U.S. Pat. No. 4,545,784, Sanderson, issued Oct. 8, 1985, discloses the adsorption of activators onto sodium perborate monohydrate.

U.S. Pat. No. 4,412,934, Chung et al, issued Nov. 1, 1983, discloses alkanoyloxybenzenesulfonate activators, including the preferred nonanoyloxybenzenesulfonate activator used herein.

SUMMARY OF THE INVENTION

The present invention relates to bleaching systems and methods which employ them for cleaning fabrics under mixed soil load conditions. Said bleaching system comprises:

a) at least about 0.1%, preferably from about 1% to about 75%, by weight, of a peroxygen bleaching compound capable of yielding hydrogen peroxide in an aqueous solution;

b) at least about 0.1%, preferably from about 0.1% to about 50%, by weight, of one or more hydrophilic N-acyl caprolactam bleach activators; and c) at least about 0.1%, preferably from about 0.1% to about 50%, by weight, of a hydrophobic alkanoyloxybenzenesulfonate bleach activator.

The preferred alkanoyl moieties of said alkanoyloxybenzenesulfonate bleach activators contain from about 8 to about 12 carbon atoms, preferably from about 8 to about 11 carbons. Highly preferred moieties are members selected from the group consisting of octanoyl, nonanoyl, decanoyl, dodecanoyl, 3,5,5-trimethylhexanoyl, 2-ethylhexanoyl, and mixtures thereof.

The acyl moieties of said N-acyl caprolactam bleach activators have the formula $R^1$—CO— wherein $R^1$ is H or an alkyl or aryl, group containing from about 1 to about 6 carbon atoms. In preferred embodiments, $R^1$ is a member selected from the group consisting of methyl, ethyl, propyl, butyl, pentyl, hexyl, and phenyl substituents.

The peroxygen bleaching compound can be any peroxide source, and is preferably a member selected from the group consisting of sodium perborate monohydrate, sodium perborate tetrahydrate, sodium pyrophosphate peroxyhydrate, urea peroxyhydrate, sodium percarbonate, sodium peroxide and mixtures thereof. Highly preferred peroxygen bleaching compounds are selected from the group consisting of sodium perborate monohydrate, sodium perborate tetrahydrate, sodium percarbonate and mixtures thereof. The most highly preferred peroxygen bleaching compound is sodium percarbonate.

The invention also encompasses detergent compositions in granular, paste, liquid, or bar form which comprise the aforesaid bleaching system together with detersive ingredients which are present in the composition at the levels indicated hereinafter.

The bleaching method herein is preferably conducted with agitation of the fabrics with an aqueous liquor containing the aforesaid compositions at levels from about 50 ppm to about 27,500 ppm, and is especially adapted for conditions in which the fabrics are soiled with both hydrophobic and hydrophilic soils. The method can be carded out at any desired washing temperature, even at temperatures below about 60° C., and is readily conducted at temperatures in the range of from about 5° C. to about 45° C. The method can be conducted conveniently using a composition which is in bar form, but can also be conducted using granules, flakes, powders, pastes, and the like.

The aqueous laundry liquor typically comprises at least about 300 ppm of conventional detergent ingredients, as well as at least about 25 ppm of the bleaching compound and at least about 25 ppm of the mixture of bleach activators. Preferably, the liquor comprises from about 900 ppm to about 20,000 ppm of conventional detergent ingredients, from about 100 ppm to about 25,000 ppm of the bleaching compound and from about 100 ppm to about 2,500 ppm of the bleach activators. The conventional detergent ingredients and bleaching system will typically be combined into a detergent composition such as a granular laundry detergent or laundry detergent bar.

The conventional detergent ingredients employed in said method and in the compositions herein comprise from about 1% to about 99.8%, preferably from about 5% to about 80%, of a detersive surfactant. Optionally, the detergent ingredients comprise from about 5% to about 80% of a detergent builder. Other optional detersive adjuncts can also be included in such compositions at conventional usage levels.

All percentages, ratios, and proportions herein are by weight, unless otherwise specified. All documents cited are incorporated herein by reference.

DETAILED DESCRIPTION OF THE INVENTION

The bleaching system employed in the present invention provides effective and efficient surface bleaching of fabrics which thereby removes stains and/or soils from the fabrics. The bleaching system is particularly efficient at cleaning a mixture of soil loads, especially mixtures of hydrophobic and hydrophilic soils. Hydrophobic soils are generally associated with lipid and protein-based soils and stains, such as body soils, blood, etc., but are also effective on so-called "dingy soils". Dingy soils are those that build up on textiles after numerous cycles of usage and washing, and result in a gray or yellow tint on white fabrics. Hydrophilic soils include food and beverage stains.

The bleaching mechanism and, in particular, the surface bleaching mechanism are not completely understood. However, it is generally believed that the N-acyl bleach activator undergoes nucleophilic attack by a perhydroxide anion, which is generated from the hydrogen peroxide evolved by the peroxygen bleaching compound, to form a peroxycarboxylic acid. This reaction is commonly referred to as perhydrolysis. It is also believed, that the N-acyl and alkanoyloxybenzenesulfonate bleach activators within this invention can render peroxygen bleaches more efficient even at laundry liquor temperatures wherein bleach activators are not necessary to activate the bleach, i.e., above about 60° C. Therefore, with bleach systems of the invention, less peroxygen bleach is required to achieve the same level of surface bleaching performance as is obtained with the peroxygen bleach alone.

The components of the bleaching system herein comprise the bleach activator and the peroxide source, as described hereinafter.

Bleach Activators

The bleach activators of type b) employed in the present invention are hydrophilic N-acyl caprolactams of the formula:

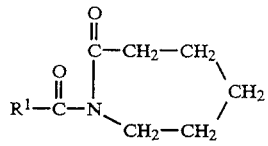

wherein $R^1$ is H or an alkyl, aryl, alkaryl, or alkoxyaryl group containing from about 1 to about 6 carbon atoms. Caprolactam activators wherein the $R^1$ moiety contains from about 1 to about 6 carbon atoms provide hydrophilic bleaching which affords beverage and food stain removal.

Benzoyl caprolactam, i.e., wherein $R^1$ is a phenyl substituent, has now been found to be unique among the bleach activator compounds, inasmuch as it appears to exhibit both hydrophobic and hydrophilic bleaching activity. This hydrophobic/hydrophilic bleaching capability makes benzoyl caprolactam the activator of choice for the formulator who is seeking broad spectrum bleaching activity, and wishes to use a single caprolactam activator for hydrophilic cleaning and for additional hydrophobic performance in combination with the alkanoyloxybenzenesulfonate activator.

Highly preferred hydrophilic N-acyl caprolactams are selected from the group consisting of formyl caprolactam, acetyl caprolactam, propanoyl caprolactam, butanoyl caprolactam, pentanoyl caprolactam, hexanoyl caprolactam, and benzoyl caprolactam.

Methods of making N-acyl caprolactams are well known in the art. Example I, included below, illustrates a preferred laboratory synthesis. Contrary to the teachings of U.S. Pat. No. 4,545,784, cited above, the bleach activator is preferably not absorbed onto the peroxygen bleaching compound. To do so in the presence of other organic detersive ingredients could cause safety problems.

The bleach activators of type c) employed in the present invention are alkanoyloxybenzenesulfonates of the formula:

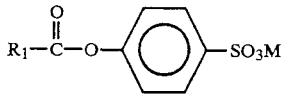

wherein $R^1$—C(O)— contains from about 8 to about 12, preferably from about 8 to about 11, carbon atoms and M is a suitable cation, such as an alkali metal, ammonium, or substituted ammonium cation, with sodium and potassium being most preferred.

Highly preferred hydrophobic alkanoyloxybenzenesulfonates are selected from the group consisting of nonanoyloxybenzenesulfonate, 3,5,5-trimethylhexanoyloxybenzenesulfonate, 2-ethylhexanoyloxybenzenesulfonate, octanoyloxybenzenesulfonate, decanoyloxybenzenesulfonate, dodecanoyloxybenzenesulfonate, and mixtures thereof.

The bleaching system comprises at least about 0.1%, preferably from about 0.1% to about 30%, more preferably from about 1% to about 30%, most preferably from about 3% to about 25%, by weight, of type b) and type c) bleach activators.

When the activators are used, optimum surface bleaching performance is obtained with washing solutions wherein the pH of such solution is between about 8.5 and 10.5, preferably between 9.5 and 10.5, in order to facilitate the perhydrolysis reaction. Such pH can be obtained with substances commonly known as buffering agents, which are optional components of the bleaching systems herein.

The Peroxygen Bleaching Compound

The peroxygen bleaching compounds useful herein are those capable of yielding hydrogen peroxide in an aqueous liquor. These compounds are well known in the art and include hydrogen peroxide and the alkali metal peroxides, organic peroxide bleaching compounds such as urea peroxide, and inorganic persalt bleaching compounds, such as the alkali metal perborates, percarbonates, perphosphates, and the like. Mixtures of two or more such bleaching compounds can also be used, if desired.

Preferred peroxygen bleaching compounds include sodium perborate, commercially available in the form of mono-, tri-, and tetra-hydrate, sodium pyrophosphate peroxyhydrate, urea peroxy-hydrate, sodium peroxide, and sodium percarbonate. Particularly preferred are sodium perborate tetrahydrate, sodium perborate monohydrate and sodium percarbonate. Sodium percarbonate is especially preferred because it is very stable during storage and yet still dissolves very quickly in the bleaching liquor. It is believed that such rapid dissolution results in the formation of higher levels of percarboxylic acid and, thus, enhanced surface bleaching performance.

Highly preferred percarbonate can be in uncoated or coated form. The average particle size of uncoated percarbonate ranges from about 400 to about 1200 microns, most preferably from about 400 to about 600 microns. If coated percarbonate is used, the preferred coating materials include mixtures of carbonate and sulphate, silicate, borosilicate, or fatty carboxylic acids.

The bleaching system comprises at least about 0.1%, preferably from about 1% to about 75%, more preferably from about 3% to about 40%, most preferably from about 3% to about 25%, by weight, of a peroxygen bleaching compound capable of yielding hydrogen peroxide in an aqueous solution.

The weight ratio of bleach activator to peroxygen bleaching compound in the bleaching system typically ranges from about 2:1 to 1:5. In preferred embodiments, the ratio ranges from about 1:1 to about 1:3.

The bleach activator/bleaching compound systems herein are useful per se as bleaches. However, such bleaching systems are especially useful in compositions which can comprise various detersive adjuncts such as surfactants, builders, enzymes, and the like as disclosed hereinafter.

Detersive Surfactant

The amount of detersive surfactant included in the fully-formulated detergent compositions afforded by the present invention can vary from about 1% to about 99.8%, by weight of the detergent ingredients, depending upon the particular surfactants used and the effects desired. Preferably, the detersive surfactants comprise from about 5% to about 80%, by weight of the detergent ingredients.

The detersive surfactant can be nonionic, anionic, ampholytic, zwitterionic, or cationic. Mixtures of these surfactants can also be used. Preferred detergent compositions comprise anionic detersive surfactants or mixtures of anionic surfactants with other surfactants, especially nonionic surfactants.

Nonlimiting examples of surfactants useful herein include the conventional $C_{11}$–$C_{18}$ alkyl benzene sulfonates and primary, secondary, and random alkyl sulfates, the $C_{10}$–$C_{18}$ alkyl alkoxy sulfates, the $C_{10}$–$C_{18}$ alkyl polyglycosides and their corresponding sulfated polyglycosides, $C_{12}$–$C_{18}$ alpha-sulfonated fatty acid esters, $C_{12}$–$C_{18}$ alkyl and alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like. Other conventional useful surfactants are listed in standard texts.

One particular class of adjunct nonionic surfactants especially useful herein comprises the polyhydroxy fatty acid amides of the formula:

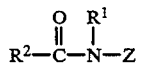

(I)

wherein: $R^1$ is H, $C_1$–$C_8$ hydrocarbyl, 2-hydroxyethyl, 2-hydroxypropyl, or a mixture thereof, preferably $C_1$–$C_4$ alkyl, more preferably $C_1$ or $C_2$ alkyl, most preferably $C_1$ alkyl (i.e. methyl); and $R^2$ is a $C_5$–$C_{32}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{19}$ alkyl or alkenyl, or mixture thereof; and Z is a polyhydroxyhydrocarbyl moiety having a linear hydrocarbyl chain with at least 2 (in the case of glyceraldehyde) or at least 3 hydroxyls (in the case of other reducing sugars) directly connected to the chain, or an alkoxylated derivative (preferably ethoxylated or propoxylated) thereof. Z preferably will be derived from a reducing sugar in a reductive amination reaction; more preferably Z is a glycityl moiety. Suitable reducing sugars include glucose, fructose, maltose, lactose, galactose, mannose, and xylose, as well as glyceraldehyde. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 1 to 5, inclusive, and R' is H or a cyclic mono- or poly-saccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-isobutyl, N-2-hydroxy ethyl, or N-2-hydroxy propyl. For highest sudsing, $R^1$ is preferably methyl or hydroxyalkyl. If lower sudsing is desired, $R^1$ is preferably $C_2$–$C_8$ alkyl, especially nopropyl, iso-propyl, n-butyl, iso-butyl, pentyl, hexyl and 2-ethyl hexyl.

$R^2—CO—N<$ can be, for example, cocamide, stearamide, oleamide, lauramide, myristamide, capricamide, palmitamide, tallowamide, etc.

Detergent Builders

Optional detergent ingredients employed in the present invention contain inorganic and/or organic detergent builders to assist in mineral hardness control. If used, these builders comprise from about 5% to about 80% by weight of the detergent compositions.

Inorganic detergent builders include, but are not limited to, the alkali metal, ammonium and alkanolammonium salts of polyphosphates (exemplified by the tripolyphosphates, pyrophosphates, and glassy polymeric metaphosphates), phosphonates, phytic acid, silicates, carbonates (including bicarbonates and sesquicarbonates), sulphates, and aluminosilicates. However, non-phosphate builders are required in some locales.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck, available from Hoechst under the trademark "SKS"; SKS-6 is an especially preferred layered silicate builder.

Carbonate builders, especially a finely ground calcium carbonate with surface area greater than 10 $m^2/g$, are preferred builders that can be used in granular compositions. The density of such alkali metal carbonate built detergents can be in the range of 450–850 g/l with the moisture content preferably below 4%. Examples of carbonate builders are the alkaline earth and alkali metal carbonates as disclosed in German Patent Application No. 2,321,001 published on Nov. 15, 1973.

Aluminosilicate builders are especially useful in the present invention. Preferred aluminosilicates are zeolite builders which have the formula:

$$Na_z[(AlO_2)_z(SiO_2)_y]xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), and Zeolite X. Preferably, the aluminosilicate has a particle size of about 0.1–10 microns in diameter.

Organic detergent builders suitable for the purposes of the present invention include, but are not restricted to, a wide variety of polycarboxylate compounds, such as ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987.

Other useful detergent builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are preferred polycarboxylate builders that can also be used in granular compositions, especially in combination with zeolite and/or layered silicate builders.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Optional Detersive Adjuncts

As a preferred embodiment, the conventional detergent ingredients employed herein can be selected from typical detergent composition components such as detersive surfactants and detergent builders. Optionally, the detergent ingredients can include one or more other detersive adjuncts or other materials for assisting or enhancing cleaning performance, treatment of the substrate to be cleaned, or to modify the aesthetics of the detergent composition. Usual detersive adjuncts of detergent compositions include the ingredients set forth in U.S. Pat. No. 3,936,537, Baskerville et al. Adjuncts which can also be included in detergent compositions employed in the present invention, in their conventional art-established levels for use (generally from 0% to about 20% of the o detergent ingredients, preferably from about 0.5% to about 10%), include enzymes, especially proteases, lipases and cellulases, color speckles, suds boosters, suds suppressors, antitarnish and/or anticorrosion agents, soil-suspending agents, soil release agents, dyes, fillers, optical brighteners, germicides, alkalinity sources, hydrotropes, antioxidants, enzyme stabilizing agents, perfumes, solvents, solubilizing agents, clay soil removal/anti-redeposition agents, polymeric dispersing agents, processing aids, fabric softening components static control agents, etc.

Bleach systems optionally, but preferably, will also comprise a chelant which not only enhances bleach stability by scavenging heavy metal ions which tend to decompose bleaches, but also assists in the removal of polyphenolic stains such as tea stains, and the like. Various chelants, including the aminophosphonates, available as DEQUEST from Monsanto, the nitrilotriacetates, the hydroxyethyl-ethylenediamine triacetates, and the like, are known for such use. Preferred biodegradable, non-phosphorus chelants include ethylenediamine disuccinate ("EDDS"; see U.S. Pat. No. 4,704,233, Hartman and Perkins), ethylenediamine-N,N'-diglutamate (EDDG) and 2-hydroxypropylenediamine-N,N'-disuccinate (HPDDS) compounds. Such chelants can be used in their alkali or alkaline earth metal salts, typically at levels from about 0.1% to about 10% of the present compositions.

Optionally, the detergent compositions employed herein can comprise, in addition to the bleaching system of the present invention, one or more other conventional bleaching agents, activators, or stabilizers which are not rendered ineffective from interaction with the nucleophilic and body soils. In general, the formulator will ensure that the bleach compounds used are compatible with the detergent formulation. Conventional tests, such as tests of bleach activity on storage in the presence of the separate or fully-formulated ingredients, can be used for this purpose.

Specific examples of optional bleach activators for incorporation in this invention include, hydrophobic N-acyl caprolactam bleach activators wherein the acyl moiety contains from 6 to 12 carbon atoms, the benzoxazin-type bleaching activators disclosed in U.S. Pat. No. 4,966,723, Hodge et al, issued Oct. 30, 1990, and the bleach agents and activators disclosed in U.S. Pat. No. 4,634,551, Burns et al, issued Jan. 6, 1987. Such bleaching compounds and agents can be optionally included in detergent compositions in their conventional art—established levels of use, generally from 0% to about 15%, by weight of detergent composition.

Bleaching activators of the invention are especially useful in conventional laundry detergent compositions such as those typically found in granular detergents or laundry bars. U.S. Pat. No. 3,178,370, Okenfuss, issued Apr.13, 1965, describes laundry detergent bars and processes for making them. Philippine Patent 13,778, Anderson, issued Sep. 23, 1980, describes synthetic detergent laundry bars. Methods for making laundry detergent bars by various extrusion methods are well known in the art.

The following examples are given to further illustrate the present invention, but are not intended to be limiting thereof.

EXAMPLE I

Synthesis of Benzoyl Caprolactam—To a two liter three necked round bottomed flask equipped with a condenser, overhead stirrer and 250 ml addition funnel is charged 68.2 g (0.6 moles) caprolactam, 70 g (0.7 moles) triethylamine and liter of dioxane; the resulting solution is heated to reflux (120° C.). A solution of 84.4 g (0.6 moles) benzoyl chloride dissolved in 200 ml of dioxane is then added over 30 minutes, and the mixture is refiuxed for a further 6 hours. The reaction mixture is then cooled, filtered, and the solvent removed by rotary evaporation to yield 121.7 g of the product as an oil which crystallizes on standing. This crude product is then redissolved in toluene and precipitated with hexane, yielding 103 g (79% theoretical yield) of a white solid which is shown by NMR to be over 95% pure, with the remaining material being benzoic acid.

EXAMPLE II

Synthesis of Nonanoyloxybenzenesulfonate—A 500 ml 3-neck flask is fitted with a reflux condenser and mechanical stirrer. The flask is purged with nitrogen and charged with 0.25 moles on nonanoyl chloride in 200 ml of dry toluene. Anhydrous p-phenolsulfonate, monosodium salt (0.20 moles) is added as a powder, and the resulting mixture refiuxed under nitrogen for 16 hours. The mixture is cooled to room temperature and diluted with 200 ml diethyl ether. The precipitated solid is collected by filtration and washed with 100 ml of diethyl ether. The solid is triturated with 200 ml of boiling methanol. After cooling, the solid is collected by filtration, washed with 100 ml of methanol, and dried under vacuum. NMR and cationic titration analyses shows the resulting nonanoyloxybenzenesulfonate, sodium salt (0.15 moles) to be over 98% pure.

EXAMPLE III

A granular detergent composition is prepared comprising the following ingredients.

| Component | Weight % |
|---|---|
| $C_{12}$ linear alkyl benzene sulfonate | 22 |
| Phosphate (as sodium tripolyphosphate) | 20 |
| Sodium carbonate | 10 |
| Sodium silicate | 3 |
| Sodium percarbonate* | 20 |
| Ethylenediamine disuccinate chelant (EDDS) | 0.4 |
| Sodium sulfate | .5 |
| Benzoyl caprolactam | 5 |
| Nonanoyloxybenzenesulfonate | 5 |
| Minors, filler** and water | Balance to 100% |

*Average particle size of 400 to 1200 microns.
**Can be selected from convenient materials such as $CaCO_3$, talc, clay, silicates, and the like.

Aqueous crutcher mixes of heat and alkali stable components of the detergent compositions are prepared and spray-dried. The other ingredients are admixed so that the detergent composition contains the ingredients tabulated at the levels shown.

The detergent granules with bleaching system are added together with a 6 lb. (2.7 kg) load of fabrics to a Sears KENMORE washing machine. Actual weights of detergent and ester compositions are taken to provide a 1000 ppm concentration of the detergent composition in the 17 gallon (65 l) water-fill machine. The water used has 7 grains/gallon hardness and a pH of 7 to 7.5 prior to (about 9 to about 10.5 after) addition of the detergent composition.

The fabrics are laundered at 35° C. (95° F.) for a full cycle (12 min.) and rinsed at 21° C. (70° F.).

At the end of the last rinse cycle, the test swatches are dried in a dryer. Tristimulus meter readings (L,a,b) are then determined for each test swatch. Whiteness performance in terms of Hunter Whiteness Values (W) is then calculated according to the following equation:

$$W=(7\,L^2-40\,Lb)/700$$

The higher the value for W, the better the whiteness performance. In the above test, fabrics exposed to the bleaching system display significantly improved whiteness after laundering compared with fabrics which have not been exposed to the bleaching system of the invention.

EXAMPLE IV

A granular detergent composition is prepared comprising the following ingredients.

| Component | Weight % |
|---|---|
| Anionic alkyl sulfate | 7 |
| Nonionic surfactant | 5 |
| Zeolite (0.1-1.0 micron) | 10 |
| Trisodium citrate | 2 |
| SKS-6 silicate builder | 10 |
| Acrylate maleate polymer | 4 |
| Benzoyl caprolactam | 10 |
| Nonanoyloxybenzenesulfonate | 10 |
| Sodium percarbonate | 25 |
| Sodium carbonate | 5 |
| Ethylenediamine disuccinate chelant (EDDS) | 0.4 |
| Suds suppressor | 2 |
| Enzymes* | 1.5 |
| Soil release agent | 0.2 |

-continued

| Component | Weight % |
|---|---|
| Minors, filler** and water | Balance to 100% |

*1:1:1 mixture of protease, lipase, and cellulase.
**Can be selected from convenient materials such as $CaCO_3$, talc, clay, silicates, and the like.

Aqueous crutcher mixes of heat and alkali stable components of the detergent compositions are prepared and spray-dried. The other ingredients are admixed so that the detergent composition contains the ingredients tabulated at the levels shown.

The detergent granules with bleaching system are added together with a 2.7 kg (6 lb.) load of fabrics to an automatic washing machine. Actual weights of detergent and ester compositions are taken to provide a 5000 ppm concentration of the detergent composition in the 17 liter (4.5 gallon) water-fill machine. The water used has 7 grains/gallon hardness and a pH of 7 to 7.5 prior to (about 9 to about 10.5 after) addition of the detergent composition.

The fabrics are laundered at 40° C. (104° F.) for a full cycle (40 min.) and rinsed at 21° C. (70° F.).

At the end of the last rinse cycle, the test swatches are dried in a dryer. Tristimulus meter readings (L,a,b) are then determined for each test swatch. Whiteness performance in terms of Hunter Whiteness Values (W) is then calculated according to the following equation:

$$W=(7\,L^2-40\,Lb)/700$$

The higher the value for W, the better the whiteness performance. In the above test, fabrics exposed to the bleaching system display significantly improved whiteness after laundering compared with fabrics which have not been exposed to the bleaching system of the invention.

EXAMPLE V

A laundry bar suitable for hand-washing soiled fabrics is prepared comprising the following ingredients.

| Component | Weight % |
|---|---|
| $C_{12}$ linear alkyl benzene sulfonate | 30 |
| Phosphate (as sodium tripolyphosphate) | 7 |
| Sodium carbonate | 15 |
| Sodium pyrophosphate | 7 |
| Coconut monoethanolamide | 2 |
| Zeolite A (0.1-1.0 microns) | 5 |
| Carboxymethylcellulose | 0.2 |
| Polyacrylate (m.w. 1400) | 0.2 |
| Benzoyl caprolactam | 6.5 |
| Nonanoyloxybenzenesulfonate | 6.5 |
| Sodium percarbonate | 15 |
| Brightener, perfume | 0.2 |
| Protease | 0.3 |
| $CaSO_4$ | 1 |
| $MgSO_4$ | 1 |
| Water and Filler* | Balance to 100% |

*Can be selected from convenient materials such as $CaCO_3$, talc, clay, silicates, and the like.

The detergent laundry bars are processed in conventional soap or detergent bar making equipment as commonly used in the art. Testing is conducted following the methods used in Example IV. In the test, fabrics exposed to the bleaching system display significantly improved whiteness after laundering compared with fabrics which have not been exposed to the bleaching system of the invention.

EXAMPLE VI

A laundry bar is prepared by a procedure identical to that of Example V, with the two exceptions that 20% of a 1:1:1 mixture of pentanoyl caprolactam, hexanoyl caprolactam, and benzoyl caprolactam is substituted for the benzoyl caprolactam bleach activator, and the level of sodium percarbonate is increased to 20%. The laundering method of Example IV is repeated. In the test, all fabrics display significantly improved whiteness after laundering compared with fabrics which have not been exposed to the bleaching system of the invention.

EXAMPLE VII

A laundry bar is prepared by a procedure identical to that of Example V, with the single exception that 15% of a 1:1 mixture of acetyl caprolactam and benzoyl caprolactam is substituted for the benzoyl caprolactam bleach activator. The laundering method of Example IV is repeated. In the test, all fabrics display significantly improved whiteness after laundering compared with fabrics which have not been exposed to the bleaching system of the invention.

EXAMPLE VIII

A laundry bar is prepared by a procedure identical to that of Example V, with the single exception that an equivalent amount of 3,5,5-trimethylhexanoyloxybenzenesulfonate is substituted for the nonanoyloxybenzenesulfonate bleach activator. The laundering method of Example IV is repeated. In the test, all fabrics display significantly improved whiteness after laundering compared with fabrics which have not been exposed to the bleaching system of the invention.

EXAMPLE IX

A laundry bar is prepared by a procedure identical to that of Example V, with the exceptions that 6% of a 1:1 mixture of benzoyl caprolactam and a benzoxazin-type bleach activator, as disclosed in U.S. Pat. No. 4,966,723, is substituted for the benzoyl caprolactam bleach activator and an equivalent amount of 2-ethylhexanoyloxybenzenesulfonate is substituted for the nonanoyloxybenzene sulfonate bleach activator. The laundering method of Example IV is repeated. In the test, all fabrics display significantly improved whiteness after laundering compared with fabrics which have not been exposed to the bleaching system of the invention.

EXAMPLE X

A bleaching system is prepared comprising the following ingredients.

| Component | Weight % |
|---|---|
| Benzoyl caprolactam | 15 |
| Nonanoyloxybenzenesulfonate | 15 |
| Sodium percarbonate | 45 |
| Chelant (ethylenediamine disuccinate, EDDS) | 10 |
| Filler* and water | Balance to 100% |

*Can be selected from convenient materials such as $CaCO_3$, talc, clay, silicates, and the like.

Testing is conducted following the methods used in Example V with the single exception that the an equivalent amount of the above bleaching system is substituted for the detergent composition used in Example V. In the test, fabrics exposed to the bleaching system display significantly improved whiteness after laundering compared with fabrics which have not been exposed to the bleaching system of the invention.

While the compositions and processes of the present invention are especially useful in conventional fabric laundering operations, it is to be understood that they are also useful in cleaning system which involves low water:fabric ratios. One such system is disclosed in U.S. Pat. No. 4,489,455, Spendel, issued Dec. 25, 1984, which involves a washing machine apparatus which contacts fabrics with wash water containing detersive ingredients using a low water: fabric ratio rather than the conventional method of immersing fabrics in an aqueous bath. The compositions herein provide excellent bleaching performance in such mechanical systems. Typically, the ratio of water:fabric ranges from about 0.5:1 to about 6:1 (liters of water:kg of fabric).

EXAMPLE XI

Using the machine and operating conditions disclosed in U.S. Pat. No. 4,489,455, cited above, 25 grams of a composition according to Example V herein are used to launder fabrics with concurrent bleaching. If desired, sudsing of the composition can be minimized by incorporating therein from 0.2% to 2% by weight of a fatty acid, secondary alcohol, or silicone suds controlling ingredient. In the test, fabrics exposed to the bleaching system display significantly improved whiteness after laundering compared with fabrics which have not been exposed to the bleaching system of the invention.

Contrary to the teachings of U.S. Pat. No. 4,545,784, cited above, the bleach activator is preferably not absorbed onto the peroxygen bleaching compound. To do so in the presence of other organic detersive ingredients could cause safety problems. It has now been discovered that the caprolactam bleach activators of this invention can be dry-mixed with peroxygen bleaching compounds, especially perborate, and thereby avoid potential safety problems.

EXAMPLE XII

A laundry bar suitable for hand-washing soiled fabrics is prepared comprising the following ingredients.

| Component | Weight % |
|---|---|
| Linear alkyl benzene sulfonate | 30 |
| Phosphate (as sodium tripolyphosphate) | 7 |
| Sodium carbonate | 20 |
| Sodium pyrophosphate | 7 |
| Coconut monoethanolamide | 2 |
| Zeolite A (0.1–1.0 microns) | 5 |
| Carboxymethylcellulose | 0.2 |
| Polyacrylate (m.w. 1400) | 0.2 |
| Benzoyl caprolactam | 5 |
| Nonanoyloxybenzenesulfonate | 5 |
| Sodium perborate tetrahydrate | 10 |
| Brightener, perfume | 0.2 |
| Protease | 0.3 |
| $CaSO_4$ | 1 |
| $MgSO_4$ | 1 |
| Water | 4 |
| Filler* | Balance to 100% |

*Can be selected from convenient materials such as $CaCO_3$, talc, clay, silicates, and the like.

The detergent laundry bars are processed in conventional soap or detergent bar making equipment as commonly used in the an with the bleaching activator dry-mixed with the perborate bleaching compound and not affixed to the surface of the perborate. Testing is conducted following the methods used in Example IV. In the test, fabrics exposed to the bleaching system display significantly improved whiteness after laundering compared with fabrics which have not been exposed to the bleaching system of the invention.

EXAMPLE XIII

A laundry bar is prepared by a procedure identical to that of Example XII, with the single exception that an equivalent amount of 2-ethyloxybenzenesulfonate is substituted for the nonanoyloxy benzenesulfonate bleach activator. The laundering method of Example IV is repeated. In the test, all fabrics display significantly improved whiteness after laundering compared with fabrics which have not been exposed to the bleaching system of the invention.

EXAMPLE XIV

A laundry bar is prepared by a procedure identical to that of Example XII, with the exceptions that 6% of a 1:1 mixture of benzoyl caprolactam and hexanoyl caprolactam is substituted for the benzoyl caprolactam bleach activator and 6% of a 1:1 mixture of dodecanoyloxybenzenesulfonate and decanoyloxybenzenesulfonate is substituted for the nonanoyloxybenzenesulfonate bleach activator. The laundering method of Example IV is repeated. In the test, all fabrics display significantly improved whiteness after laundering compared with fabrics which have not been exposed to the bleaching system of the invention.

EXAMPLE XV

A laundry bar is prepared by a procedure identical to that of Example XII, with the single exception that 10% of a 1:1 mixture of benzoyl caprolactam and a benzoxazin-type bleach activator, as disclosed in U.S. Pat. No. 4,966,723, is substituted for the benzoyl caprolactam bleach activator. The laundering method of Example IV is repeated. In the test, all fabrics display significantly improved whiteness after laundering compared with fabrics which have not been exposed to the bleaching system of the invention.

EXAMPLE XVI

A laundry bar is prepared by a procedure identical to that of Example XII, with the single exception that 6% of a 1:1 mixture of benzoyl caprolactam and a bleach activator, as disclosed in U.S. Pat. No. 4,634,551, cited above, is substituted for the benzoyl caprolactam bleach activator. The laundering method of Example IV is repeated. In the test, all fabrics display significantly improved whiteness after laundering compared with fabrics which have not been exposed to the bleaching system of the invention.

EXAMPLE XVII

A granular detergent composition is prepared comprising the following ingredients.

| Component | Weight % |
|---|---|
| Linear alkyl benzene sulfonate | 20 |
| Phosphate (as sodium tripolyphosphate) | 20 |
| Sodium carbonate | 10 |
| Sodium silicate | 3 |
| Sodium perborate tetrahydrate | 20 |
| Ethylenediamine disuccinate chelant (EDDS) | 0.4 |
| Sodium sulfate | 5.5 |
| Hexanoyl caprolactam | 5 |
| Nonanoyloxybenzenesulfonate | 5 |

-continued

| Component | Weight % |
|---|---|
| Minors, filler** and water | Balance to 100% |

**Can be selected from convenient materials such as $CaCO_3$, talc, clay, silicates, and the like.

Aqueous crutcher mixes of heat and alkali stable components of the detergent compositions are prepared and spray-dried. The other ingredients are dry-mixed so that the detergent composition contains the ingredients tabulated at the levels shown.

Testing is conducted following the methods used in Example IV. In the test, fabrics exposed to the bleaching system display significantly improved whiteness after laundering compared with fabrics which have not been exposed to the bleaching system of the invention.

EXAMPLE XVIII

A granular detergent composition is prepared by a procedure identical to that of Example XVII, with the single exception that 15% of a 1:1 mixture of benzoyl caprolactam and hexanoyl caprolactam is substituted for the hexanoyl caprolactam bleach activator. The laundering method of Example IV is repeated. In the test, all fabrics display significantly improved whiteness after laundering compared with fabrics which have not been exposed to the bleaching system of the invention.

EXAMPLE XIX

A granular detergent composition is prepared by a procedure identical to that of Example XVIII, with the single exception that 6% of a 1:1 mixture of benzoyl caprolactam and a benzoxazin-type bleach activator, as disclosed in U.S. Pat. No. 4,966,723, is substituted for the hexanoyl caprolactam bleach activator. The laundering method of Example IV is repeated. In the test, all fabrics display significantly improved whiteness after laundering compared with fabrics which have not been exposed to the bleaching system of the invention.

EXAMPLE XX

A granular detergent composition is prepared by a procedure identical to that of Example XVIII, with the single exception that 6% of a 1:1:1 mixture of octanoyloxybenxenesulfonate, decanoyloxybenzenesulfonate and a benzoxazin-type bleach activator, as disclosed in U.S. Pat. No. 4,634,551, cited above, is substituted for the nonanoyloxybenezenesulfonate bleach activator. The laundering method of Example IV is repeated. In the test, all fabrics display significantly improved whiteness after laundering compared with fabrics which have not been exposed to the bleaching system of the invention.

A particularly preferred embodiment of this invention is a 1:2.2:7.7 molar ratio of N-acyl caprolactam to alkanoyloxybenzenesulfonate to peroxygen bleaching compound. This mixed caprolactam alkanoyloxybenzenesulfonate bleaching composition delivers stronger than expected performance on hydrophobic stains and hydrophilic stains and on dingy clean up.

EXAMPLE XXI

A laundry bar is prepared by a procedure identical to that of Example V, with the exceptions that the level of benzoyl caprolactam is 0.85%, the level of nonanoyloxybenzenesulfonate bleach activator is 3% and sodium percarbonate is substituted with 3% perborate. The laundering method of Example IV is repeated. In the test, all fabrics display significantly improved whiteness after laundering compared with fabrics which have not been exposed to the bleaching system of the invention.

EXAMPLE XXII

A granular laundry detergent is prepared by a procedure identical to that of Example III, with the exceptions that the level of benzoyl caprolactam is 0.85%, the level of nonanoyloxybenzenesulfonate bleach activator is 3% and sodium percarbonate is substituted with 3% perborate. The laundering method of Example III is repeated. In the test, all fabrics display significantly improved whiteness after laundering compared with fabrics which have not been exposed to the bleaching system of the invention.

EXAMPLE XXIII

A granular laundry detergent is prepared by a procedure identical to that of Example IV, with the exceptions that the level of benzoyl caprolactam is 0.85%, the level of nonanoyloxybenzenesulfonate bleach activator is 3% and sodium percarbonate is substituted with 3% perborate. The laundering method of Example IV is repeated. In the test, all fabrics display significantly improved whiteness after laundering compared with fabrics which have not been exposed to the bleaching system of the invention.

EXAMPLE XXIV

A laundry bar is prepared by a procedure identical to that of Example XI, with the exceptions that the level of benzoyl caprolactam is 0.85%, the level of nonanoyloxybenzenesulfonate bleach activator is 3% and the level of sodium perborate tetrahydrate is 3%. The laundering method of Example XI is repeated. In the test, all fabrics display significantly improved whiteness after laundering compared with fabrics which have not been exposed to the bleaching system of the invention.

EXAMPLE XXV

A granular laundry detergent is prepared by a procedure identical to that of Example XVII, with the exceptions that the level of nonanoyloxybenzenesulfonate bleach activator is 3%, the level of sodium perborate tetrahydrate is 3%, and the hexanoyl caprolactam is substituted with 0.85% benzoyl caprolactam. The laundering method of Example XVII is repeated. In the test, all fabrics display significantly improved whiteness after laundering compared with fabrics which have not been exposed to the bleaching system of the invention.

While the foregoing examples illustrate the use of the present technology in cleaning/bleaching compositions designed for use in laundering, it will be appreciated by those skilled in the art that the bleaching systems herein can be employed under any circumstance where improved oxygen bleaching is desired. Thus, the technology of this invention may be used, for example, to remove stains and cleans dishes, to bleach paper pulp, to bleach hair, to cleanse and sanitize prosthetic devices such as dentures, in dentifrice compositions to clean teeth and kill oral bacteria, and in any other circumstances where bleaching is advantageous to the user.

EXAMPLE XXVI

A granular automatic dishwashing detergent composition wherein stain removal and cleaning benefits are achieved is prepared comprising the following ingredients.

| Component | % by weight of active material A | B | C |
|---|---|---|---|
| Citrate | 15.00 | 15.00 | 20.00 |
| Acusol 480N[1] | 6.00 | 6.00 | 6.90 |
| Sodium carbonate | 20.00 | 20.00 | 23.00 |
| Britesil $H_2O$) ($SiO_2$) | 9.00 | 9.00 | 7.50 |
| Nonionic surfactant[2] | 2.00 | 2.00 | 2.00 |
| Savinase 12T | 2.00 | 2.00 | 2.00 |
| Termamyl 60T | 1.00 | 1.00 | 1.00 |
| Percarbonate (as AvO) | 1.50 | 1.50 | 1.50 |
| Nonanoyloxybenzenesulfonate | 2.00 | 2.00 | 2.00 |
| Benzoylcaprolactam | 2.00 | 3.80 | 2.00 |
| Diethylene triamine pentaacetic acid | 0.13 | 0.13 | 0.13 |
| 1,1-hydroxyethanedishosphonic acid | 0.50 | 0.50 | 0.50 |
| Sulfate, water, etc. | Balance to 100% | | |
| pH | 10.0 | 10.0 | 10.0 |

[1]Dispersant from Rohm and Haas
[2]Low cloud, high HLB nonionic surfactant

EXAMPLE XXVII

Tablet compositions of the present invention are as follows:

| Component | % by weight of active material | |
|---|---|---|
| Citrate | 20.90 | 20.90 |
| Phosphate | — | — |
| Polyacrylate | 2.70 | 2.70 |
| Carbonate | 14.00 | 14.00 |
| 1,1-hydroxyethanedishosphonic acid | 0.36 | 0.36 |
| Silicate 2r(SiO2) | 12.20 | 12.20 |
| metaSilicate (SiO2) | — | — |
| Paraffin | 0.36 | 0.36 |
| Benzotriazole | 0.21 | 0.21 |
| Perborate tetrahydrate (as AvO) | 0.64 | 0.64 |
| Perborate monohydrate (as AvO) | 0.22 | 0.22 |
| Percarbonate (as AvO) | — | — |
| Nonanoyloxybenzenesulfonate | 2.00 | 2.00 |
| Benzoylcaprolactam | 3.20 | 5.10 |
| Phenylbenzoate | — | — |
| Diethylene triamine pentamethylene phosphoric acid | 0.09 | 0.09 |
| Savinase 60T | 1.10 | 1.10 |
| Savinase 12T | 1.58 | 1.58 |
| Nonionic surfactant | 1.18 | 1.18 |
| Termamyl 60T | 1.10 | 1.10 |
| Sulfate, water, etc. | Balance to 100% | |
| pH | 11 | 11 |

Automatic dishwashing compositions may be in granular, tablet, bar, or rinse aid form. Methods of making granules, tablets, bars, or rinse aids are known in the art. See, for instance, U.S. patent Ser. Nos. 08/106,022, 08/147,222, 08/147,224, 08/147,219, 08/052,860, 07/867,941.

What is claimed is:

1. A bleaching composition comprising:

i) a peroxygen bleaching compound;

ii) a hydrophilic N-acyl caprolactam bleach activator wherein the acyl moiety of said N-acyl caprolactam is of the formula $R^1$—C(O)— wherein $R^1$ is H or an alkyl or aryl group containing from about 1 to about 6 carbon atoms; and iii) an alkanoyloxybenzenesulfonate bleach activator, wherein said alkanoyl moiety contains from about 8 to about 12 carbon atoms; such that the molar ratio of N-acyl caprolactam:alkanoyloxybenzenesulfonate:peroxygen bleaching compound is approximately 1:2.2:7.7.

2. A bleaching composition according to claim 1 wherein said N-acyl caprolactam is selected from the group consisting of benzoyl caprolactam, formyl caprolactam, acetyl caprolactam, propanoyl caprolactam, butanoyl caprolactam, pentanoyl caprolactam, hexanoyl caprolactam, and mixtures thereof; said alkanoyloxybenzenesulfonate is selected from the group consisting of nonanoyloxybenzenesulfonate, decanoyloxybenzenesulfonate, octanoyloxybenzenesulfonate, dodecanoyloxybenzenesulfonate, 3,5,5-trimethylhexanoyloxybenzenesulfonate, 2-ethylhexanoyloxybenzenesulfonate, and mixture thereof; and said peroxygen bleaching compound is selected from the group consisting of sodium perborate monohydrate, sodium perborate tetrahydrate, sodium pyrophosphate peroxyhydrate, urea peroxyhydrate, sodium percarbonate, sodium peroxide, and mixtures thereof.

3. An automatic dishwashing composition comprising a bleaching composition according to claim 1.

4. A laundry detergent composition comprising a bleaching composition according to claim 1.

5. A laundry detergent composition according to claim 4 wherein said bleaching composition comprises:

i) about 0.85% benzoyl caprolactam;

ii) about 3% nonanoyloxybenzenesulfonate; and iii) about 3% perborate bleaching compound.

6. A method for cleaning fabrics, dishes, or hard surfaces, said method comprising contacting said fabrics, dishes, or hard surfaces with a bleaching composition according to claim 1.

7. A method according to claim 6 wherein said N-acyl caprolactam is selected from the group consisting of benzoyl caprolactram, formyl caprolactam, acetyl caprolactam, propanoyl caprolactam, butanoyl caprolactam, pentanoyl caprolactam, hexanoyl caprolactam, and mixtures thereof; said alkanoyloxybenzenesulfonate is selected from the group consisting of nonanoyloxybenzenefulfonate, decanoyloxybenzenesulfonate, octanoyloxybenzenefulfonate, dodecanoyloxybenzenesulfonate, 3,5,5-trimethylhexanoyloxybenzenesulfonate, 2-ethylhexanoyloxybenzenesulfonate, and mixture thereof; and said peroxygen bleaching compound is selected from the group consisting of sodium perborate monohydrate, sodium perborate tetrahydrate, sodium pyrophosphate peroxyhydrate, urea peroxyhydrate, sodium percarbonate, sodium peroxide, and mixtures thereof.

8. A method according to claim 7 wherein said N-acyl caprolactam is benzoyl caprolactam, said alkanoyloxybenzenesulfonate is nonanoyloxybenzenesulfonate, and said peroxygen bleaching compound is selected from the group consisting of sodium perborate monohydrate, sodium perborate tetrahydrate, sodium percarbonate, and mixtures thereof.

* * * * *